US005252146A

United States Patent [19]

Wen et al.

[11] Patent Number: 5,252,146

[45] Date of Patent: Oct. 12, 1993

[54] COAT-NITROCARBURIZING OF IRONS AND STEELS

[75] Inventors: Lianyu Wen; Jiwei Shi; Reginald W. Smith, all of Kingston, Canada

[73] Assignee: Queen's University, Kingston, Canada

[21] Appl. No.: 933,634

[22] Filed: Aug. 24, 1992

[51] Int. Cl.[5] ..... C21D 1/06

[52] U.S. Cl. ..... 148/219; 148/218

[58] Field of Search ..... 148/219, 218, 319

[56] References Cited

FOREIGN PATENT DOCUMENTS 56-84416 7/1981 Japan ..... 148/219

775170 10/1980 U.S.S.R. ..... 148/218

*Primary Examiner*—Deborah Yee

*Attorney, Agent, or Firm*—Richard J. Hicks

[57] ABSTRACT

A process for nitrocarburizing ferrous materials, and the product thereof is described. Material to be treated is packed in a container with a triazine polymer, preferably melone, melem or melam and heated to 500°-900° C. for up to 120 minutes. After treatment the material can be oil quenched to produce a product having a diffusion layer and or a relatively thick hard nitrocarburized (outer) layer which is 40-200 μm thick and has a hardness in the range HV 400-1500.

5 Claims, 1 Drawing Sheet

COAT-NITROCARBURIZING OF IRONS AND STEELS

FIELD OF INVENTION

This invention relates to a process for nitrocarburizing of iron and steel. More particularly, this invention relates to a process which here is named "coat nitrocarburizing" employing a triazine polymer reagent as the source of carbon and nitrogen.

BACKGROUND OF INVENTION

Nitriding and Nitrocarburizing are well known diffusion processes for case hardening irons and steels so as to produce a high surface hardness, increase wear and heat resistance, and improve fatigue life and corrosion resistance.

In conventional gaseous nitrocarburizing of irons and steels, a gaseous atmosphere is employed to provide active nitrogen and carbon simultaneously to iron/steel components to form the desired epsilon phase on the surface. The most commonly used source for active nitrogen is ammonia and for active at least one of the carburizing gases such as natural gas, propane, carbon an endothermic or exothermic gas reaction produces carbon insitu. One typical atmosphere contains equal amount of ammonia and an endothermic gas and another costs of 35% ammonia and 65% refined exothermic gas which may be enriched with a hydrocarbon gas. Most gaseous nitrocarburizing processes are performed at about 565° C., a temperature just below the austenite temperature range for the Fe-N-C system. The treatment times generally range from 1 to 5 h. However the treatment temperature cannot be raised as ammonia gas used for equilibration decomposes rapidly with increase of temperature, before reaching the surface of the components to be treated. Therefore, gaseous nitrocarburization cannot generally be applied at 700° C.

Prior art processes include Nitemper® and Triniding® (Ipsen & Surface Combustion Inc. USA) 1961; Nitrotec (Lucas Electrical Co. UK) 1982; QPQ (Degussa, Germany) 1973; LT (Wuhan Inst. of Materials Protection, China) 1984 and FON (Tianjin Inst. of Textile Science and Technology, China) 1987. Attention is also directed to Published European Patent application 0323511, filed 16 Jun. 1987, laid open 12 Jul. 1989, Gorodetsky et al, which describes a low temperature process for nitrocarburizing using an organic polyamide reagent. A comparison of the products of these processes is presented in Table I below. Most processes are carried out at a temperature below 700° C. Obviously Gorodestky's process is easier and simpler than the above nitrocarburization processes, and a diffusion zone of 60–90 μm depth may be formed in about 2–4h for alloy tool steels, but the nitrocarburizing process is still carried out at a low temperature range.

There is, therefore, a need for a nitrocarburizing process which is operable at a higher temperature in order to achieve maximum properties of the treated metal.

Table I

| Process | Penetrated element | T(°C.) | Time (h) | Compound layer (μm) | Diffusion zone(μm) |
|---|---|---|---|---|---|
| Nitemper | N + C | 570 | 3 | 18 | |
| Triniding | N + C | 570 | 4 | 12 | |

Table I-continued

| Process | Penetrated element | T(°C.) | Time (h) | Compound layer (μm) | Diffusion zone(μm) |
|---|---|---|---|---|---|
| Nitrotec | N + C + O | 550–740 | 3 | 25 | |
| QPQ | N + C + O | 570 | 2 | 18–22 | 550 |
| LT | N + C + S | 570 | 3 | 18–25 | 600 |
| FON | N + C + O | 570 | 1 | 28 | 540 |
| | | 520–540 | 0.3–0.5 | | 30–60* |
| Gorodetsky | N + C | 480–680 | 2–4 | | 60–90* |

*high alloy steels

OBJECT OF INVENTION

Thus, it is an object of the present invention to provide a nitrocarburizing process for providing a sub-surface diffusion layer and a hard nitrocarburized surface layer which includes a compound layer and an austenite-martensite layer on an iron or steel product, which can be operated at a temperature between about 500° C. to 900° C. to produce a relatively thick, hard nitrocarburized surface layer in about 120 minutes.

Another object of this invention is to produce an iron or steel product having a case hardened layer up to 200 μm thick and having a hardness between 400 and 1500 DPH.

BRIEF STATEMENT OF INVENTION

Thus, by one aspect of this invention there is provided a process for nitrocarburizing ferrous objects comprising:

(a) loading said objects into a container with a triazine polymer;

(b) sealing said container;

(c) heating said sealed container at a temperature in the range of 500°–900° C. for a period up to about 120 minutes;

(d) opening said container; and (e) quenching said objects.

By another aspect of this invention there is provided a nitrocarburized product comprising a ferrous substrate having an integral diffusion layer thereon and an integral hard nitrocarburized surface layer.

DETAILED DESCRIPTION OF PREFERRED EMBODIMENTS

Figure 1:
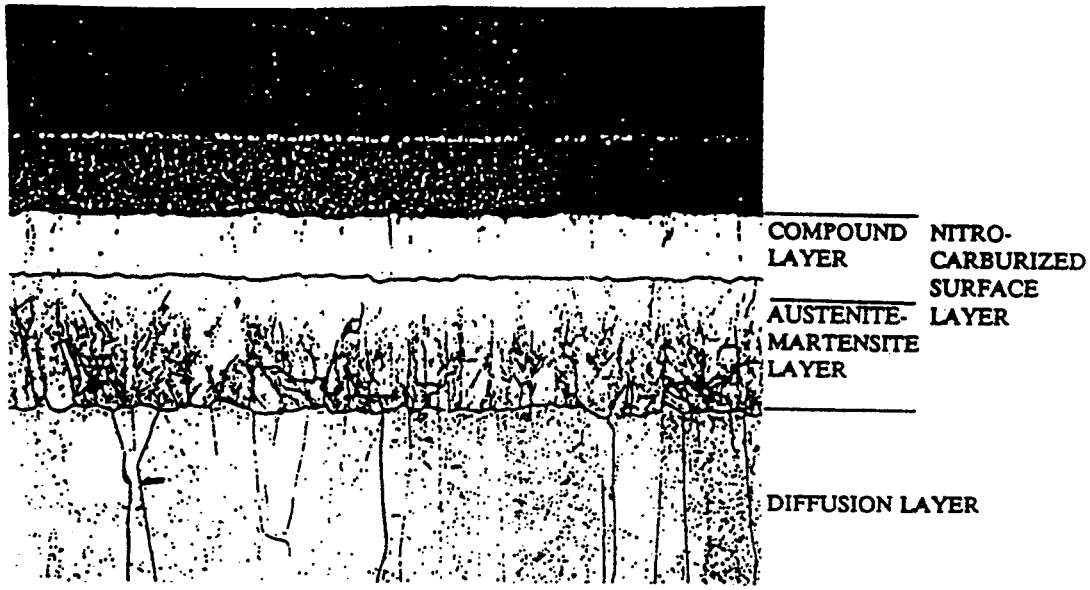
FIG. 1 is a photomicrograph of a sample of pure iron treated according to the present invention at 700° C. for 60 minutes; at a magnification of ×400.

The triazine polymer reagent used in the present invention is preferably a polymerization product of melamine and more preferably is selected from the group comprising melone, melem and melam (CAS Registry number 32518-77-7, 1502-47-2 and 3576-88-3 respectively).

Melone (Melon), melem and melam are well known polymers of melamine and can be formed by heating melamine above 350° C. to effect partial desamidization (see U.S. Pat. No. 2,197,357 Widmer).

Melone, melem and melam are extremely stable under normal environmental conditions without any toxic or dangerous constituents. Melem and melam are temperature resistant at 350° C. and they start to sublimate above 350° C. Melone is stable in air at temperatures up to 600° C. but begins to sublime above this temperature. The vapour phase products of sublimation adhere and stick on the surfaces of irons and steels to form a fine coat. The melone, melem and melam effectively catalytically dissociate on the surface and become a source of active nitrogen and carbon at higher temperature.

The iron/steel components which may be ferritic steel, alloy steel, cast iron or sintered steel, to be coat-nitrocarburized are loaded, preferably with 0.1-1.0 wt % of triazine polymer, into a closed container or a container which may be air evacuated after loading into a furnace. The sealed containers are then heated up to 500°-900° C. and held for 10-120 min. A container of minimum volume is preferred. The amount of triazine polymer loaded depends on the treatment temperature and the surface/volume fraction of the metal loaded. The higher the treating temperature and the larger the surface/volume fraction the higher the percentage of triazine polymer reagent required. The triazine polymer begins to sublime at 350° C. and becomes a vapour phase forming a coating on charged metal for nitrocarburization. The nitrocarburizing speed increases with an increase in treatment temperature. However, a treatment temperature of about 700° C. for carbon steel is preferable. In order to increase the fatigue strength of the products, the part must be quickly quenched in oil after the coat-nitrocarburizing.

EXAMPLE 1

Pure iron samples (10 mm×10 mm×25 mm), total weight of 2090 g were loaded into a 150×150 mm titanium cylindrical container with 20 g triazine polymer and the container was sealed. The container was then placed in an electric resistance furnace and heated at 700° C. for 60 minutes. After this time the container was opened and the samples were oil quenched and examined. The samples had a hardness of HV 868±36 and a nitrocarburized layer 60-70 μm thick.

EXAMPLE 2

The procedure of Example 1 was repeated with AISI 1020 steel samples, and the treated samples had a hardness of HV 717±90 and a nitrocarburized layer 40-50 μm thick.

EXAMPLE 3

The procedure of Example 1 was repeated with AISI 1060 steel samples and the loaded samples had a hardness of HV 798±53 and a nitrocarburized layer 50-70 μm thick.

EXAMPLE 4

The procedure of Example 3 was repeated at a temperature of 800° C. for 10 minutes. The resulting treated samples had a hardness of HV 456±73 and a nitrocarburized layer of 100-125 μm.

EXAMPLE 5

The procedure of Example 1 was repeated with High Speed Steel (HSS) samples which were heated for 60 minutes at 565° C. The thickness of the diffusion zone was 65-75 μm and the hardness was HV 1547±27.

EXAMPLE 6

Example 2 was repeated at a temperature of 565° C. and the compound layer was found to be 6.0-8.0 μm.

From the above examples it is clear that a triazine polymer agent can be used for both ferritic and alloy steels to produce an outer very hard, tribological, corrosion resistant surface nitrocarburized layer and an inner diffusion zone with temperature and fatigue resistance properties, as is conventional with nitrocarburizing processes, but with a much thicker nitrocarburized surface layer which comprises an outer compound layer and an inner austenite-martensite layer (see FIG. 1).

The triazine polymer reagents of the present invention permit the use of a higher treatment temperature, with a consequent reduction in treatment time, to produce a thicker and harder nitrocarburized surface layer than is possible using either the gaseous or solid polyamide reagents of the prior art.

We claim:

1. A process for nitrocarburizing ferrous objects comprising:
   (a) loading said objects into a container with a triazine polymer;
   (b) sealing said container;
   (c) heating said sealed container at a temperature in the range of 500°-900° C. for a period up to about 120 minutes;
   (d) opening said container; and
   (e) quenching said objects.

2. A process as claimed in claim 1 wherein said triazine polymer is selected from the group consisting of melone, melem and melam.

3. A process as claimed in claim 2 wherein said ferrous object is selected from ferritic steel, alloy steel, cast iron and sintered steels.

4. A process as claimed in claim 3 wherein said object is heated period of 60-120 minutes to thereby produce a layer about 40-200 μm thick.

5. A process as claimed 3 wherein said triazine polymer is present in said container in an amount between 0.05 and 20 wt %.

* * * * *